US006883257B2

(12) United States Patent
Couch et al.

(10) Patent No.: US 6,883,257 B2
(45) Date of Patent: Apr. 26, 2005

(54) IRONING BOARD

(76) Inventors: Kenneth J. Couch, 503 Duran St., Henderson, NV (US) 89015; Wayne A. Slater, 109 Ruidoso La., Henderson, NV (US) 89074-1001

( * ) Notice: Subject to any disclaimer, the term of this patent is extended or adjusted under 35 U.S.C. 154(b) by 130 days.

(21) Appl. No.: 10/387,459

(22) Filed: Mar. 14, 2003

(65) Prior Publication Data

US 2003/0172558 A1 Sep. 18, 2003

Related U.S. Application Data

(60) Provisional application No. 60/364,044, filed on Mar. 15, 2002.

(51) Int. Cl.[7] ..... D06F 81/00

(52) U.S. Cl. ..... 38/107; 38/135

(58) Field of Search ..... 38/106, 107, 137, 38/143; 219/245, 246, 247, 250, 256; 381/88, 103, 152, 167

(56) References Cited

U.S. PATENT DOCUMENTS 1,490,435 A * 4/1924 Sackett ..... 38/137
2,249,110 A * 7/1941 Browning ..... 38/104
2,282,300 A * 5/1942 Place ..... 38/137
2,331,673 A * 10/1943 Fay ..... 38/104
2,506,459 A * 5/1950 Lampiris ..... 38/104
5,290,998 A 3/1994 Couch et al. ..... 219/247

FOREIGN PATENT DOCUMENTS

EP A-0126530 11/1984 ..... D06F/81/08
FR 1248806 * 11/1960

* cited by examiner

*Primary Examiner*—Ismael Izaguirre
(74) *Attorney, Agent, or Firm*—Nath & Associates PLLC; Harold L. Novick

(57) ABSTRACT

An ironing board has an electrically heated working surface with an electrical heater element disposed therein and an electrical connector for connection of an electrically heated iron. A power management system within the ironing board has a sensor that detects whether the iron is connected to the ironing board. The ironing board and iron can be selectively set to one of a plurality of heat ranges. The power management system detects thermostatically regulated demands for electrical current by each of the ironing board and iron and a controller selectively provides electrical current to at most one of the ironing board heater element and iron so as to not exceed a predetermined maximum electrical current. Control circuitry provides either a fixed or proportional temperature differential between the ironing board and the connected iron. The ironing board can include a height adjuster for selectively adjusting a height of the ironing board.

8 Claims, 5 Drawing Sheets

IRONING BOARD

CROSS-REFERENCE TO RELATED APPLICATIONS

The Present Application claims the benefit under 35 U.S.C. §119(e) of provisional patent application Ser. No. 60,364,044 filed on Mar. 15, 2002, the entirety of which is hereby incorporated by reference.

BACKGROUND OF THE INVENTION

1. Field of the Invention

This invention relates to domestic ironing boards of the type including heating elements to enable clothes to be ironed by applying heat both from the board and from the iron.

2. Background Information

EP-A-0126530 describes an ironing board which is heatable by means of an electrical heater element mounted in the board and controlled by a control circuit also mounted in the board, the control circuit including means for electrically connecting thereto an electrically-heated flat iron, whereby temperature control of the iron can be effected from the control circuit on the board. Preferably, the heater elements of the board and the iron are supplied from a common source, whereby control of both iron and board can be effected from the same circuit to maintain the temperature of the iron according to a setting relating to the board temperature.

U.S. Pat. No. 5,290,998 describes a cordless iron in combination with a power control module, the iron having a temperature sensor in thermal contact with the sole plate, whereby feedback control circuitry controls the power supply according to the perceived temperature of the sole plate in relation to the set temperature. The control module may be installed in an ironing board with an inbuilt heating element. The control circuitry enables more accurate temperature control than that available with a conventional thermostat.

A problem with ironing apparatus as described above is that there is a risk of electrical overload where the board element and iron element are both being heated simultaneously. The problem is made worse by the increase in wattage of domestic irons in recent years, 2 kW now being commonplace in Europe, and especially when the board heating element requires sufficiently high power rating for initial fast heat-up and recovery during the thermostatic control cycle. The problem is even more acute in countries such as the USA with lower mains voltages creating proportionally higher current demands in excess of standard domestic outlet socket ratings, this being the principal reason why combined heated ironing broads and electric irons for double sided ironing have thus far not enjoyed commercial success in the USA.

SUMMARY OF THE INVENTION

It is an object of the present invention to provide control circuitry for an electrically-heated ironing board in combination with an electrically-heated iron which overcomes the problem identified above.

It is another object of the invention to provide control circuitry for an ironing board having a heating element rated at approximately 1500 watts, the board being suitable for use with existing commercially available domestic irons, whereby the combined use will not result in an overload on a standard domestic socket outlet of 15 or 20 amps (USA) or 13 amps (UK), even when used with mains supply voltages of 110/120 such as encountered extensively in the USA.

Accordingly, the invention provides in one aspect an ironing board comprising an electrical heater, an outlet for powering an iron, a connector for connecting the board to a power source and a controller for controlling the supply of power to the heater and the outlet, wherein the controller is arranged to prevent power being supplied to both the outlet and the heater simultaneously and to give priority to the iron if both the heater and an iron connected to the outlet request power simultaneously.

In one embodiment, the controller comprises two switches, one for selectively powering the heater and the other for selectively powering an iron connected to the socket. The switches can be triacs, for example.

The controller may comprise a sensor which detects whether an iron connected to the outlet is requesting power. Preferably, the sensor comprises an opto-isolator.

The controller may be arranged such that connection of an iron to the outlet enables the completion of a circuit to a sensor in the controller. The controller may be such that a demand for power arising within an iron connected to the outlet completes said circuit causing the sensor to signal the iron's demand to the controller.

In a preferred embodiment, the controller periodically ceases the supply of useful power to an iron connected to the outlet to determine during such cessations whether the iron is still requesting power.

In one embodiment, the controller comprises a microcontroller for dictating the supply of mains power to the outlet and the heater.

The invention thus provides a power load management system which prevents overload by prohibiting power supply simultaneously to the board element and the iron even when both are registering temperatures below their set temperatures, power under such circumstances being provided preferentially to the iron.

The iron may be customer-owned existing iron, the means to provide power to such an iron including a conventional plug and flexible cable may be adapted to accommodate a cordless or as an integral part thereof, utilising the load management system of the present invention.

Temperature control of both the board and the iron is preferably operator-variable and set from a selector means mounted for convenience on the board. The control circuitry may be programmed to provide either a fixed differential between the board and iron operating temperatures for any given setting or a proportional differential so that, for example, the higher the temperature is set, the greater is the differential. However, the board temperature may be merely controlled to a pre-set thermostatically controlled single average temperature dependent on the setting of the iron.

Preferably, the control circuitry includes switch means associated with the iron power-provision means to isolate the board element from receiving power unless an iron is connected to the iron power-provision means. Such isolation means is an important safety feature and prevents the possibility of a dangerous potential being created across the board and the iron especially in hospitals, schools, hotels and other such places, for example by using another iron fed from a different phase.

Experiments have shown that most domestic irons demand heating power for less than 50% of the total use time, including initial warm-up on a cold board, and it follows that the majority of use time is available for maintaining at the required temperature of a suitably loaded board.

Optionally as additional features, the control circuitry may include means to indicate, for example audibly via a recording, the fabrics which can be ironed at each selected board temperature setting, when multi-temperature control is used, and the board may be raised and lowered for different working heights and for storage by direct or remote electronic control of a suitable-geared integral electric motor.

BRIEF DESCRIPTION OF THE DRAWINGS

Embodiments of the invention will now be described by way of example with reference to the accompanying drawings, of which

DESCRIPTION OF THE PREFERRED EMBODIMENTS

Figure 1:
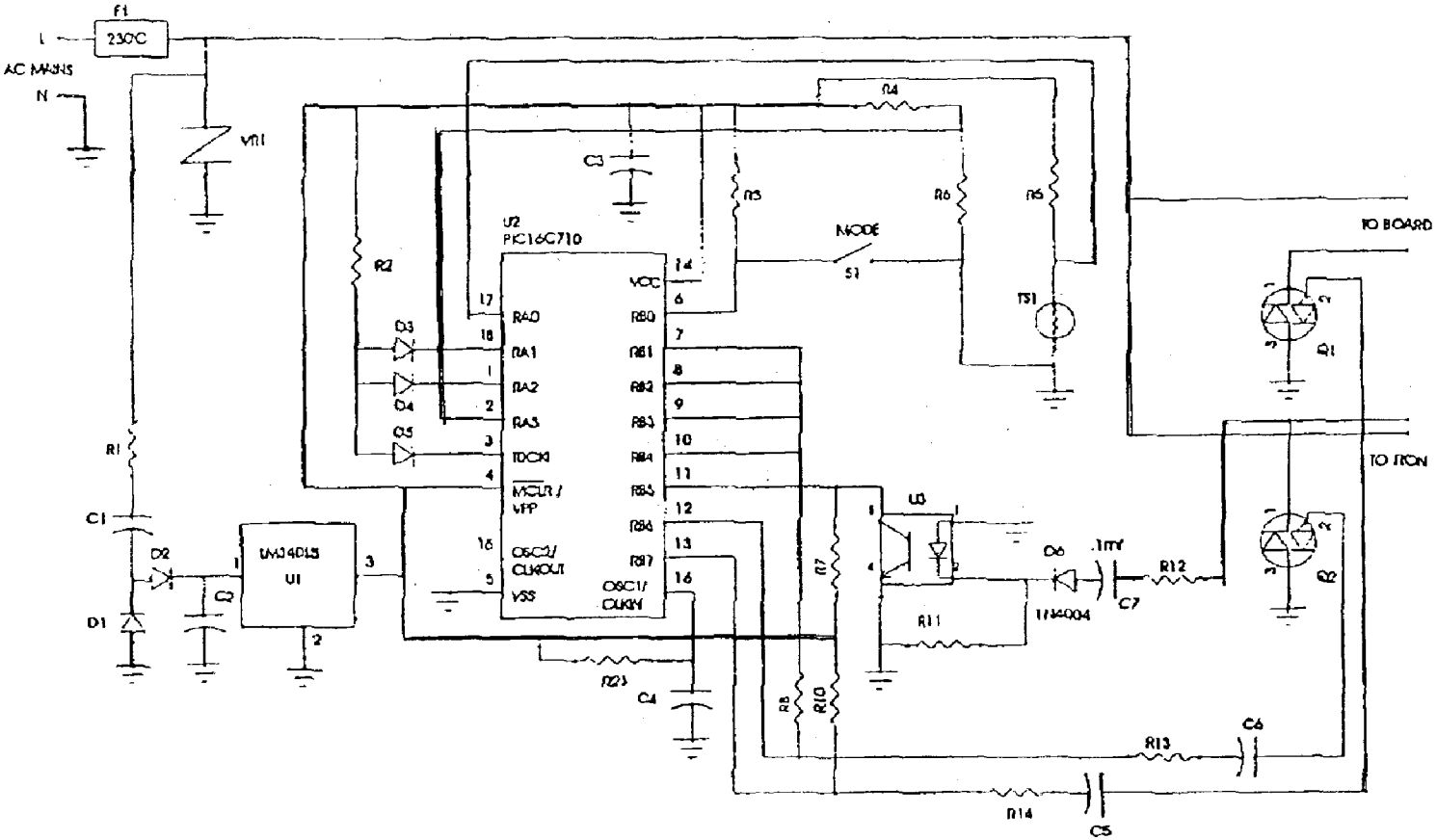
FIG. 1 is a circuit diagram of a power management system.
Figure 5:
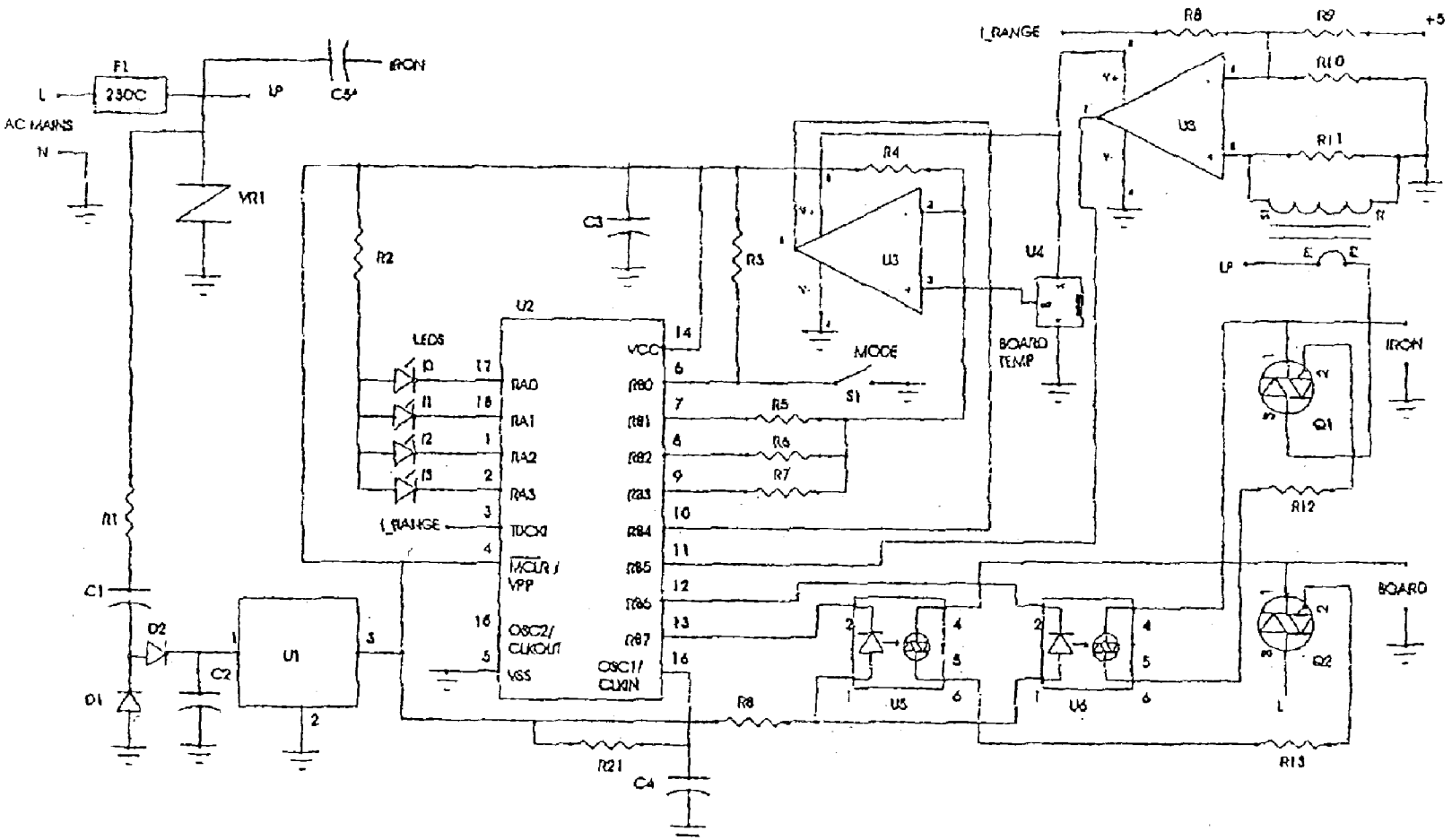
FIG. 5 is a circuit diagram of an alternative power management system.

Referring firstly to FIG. 1 and, where it contains, equivalent componentry, FIG. 5, the circuit is designed to monitor the load connected to the "Iron" output, and depending on the presence of that load determines the availability of power to the "Board" output.

Additionally, the circuit provides user functions via the "mode" switch S1. There are four modes available. Mode 0 is off. This is the default mode that occurs upon the application of AC Mains, or may be entered by successive presses of the mode switch. Modes 1, 2, and 3 are all "on" functions. Different temperature settings are programmed into each of the mode 1–3 settings. Three LEDs (D3, D4 and D5) indicate the currently selected mode. Temperature sensor TS1 is located within measurement proximity of the board and is used to provide monitoring of the board temperature by the CPU (U2).

AC Mains

The circuit common is connected to the AC Mains Neutral lead. The Line or "hot" lead powers the circuit via a thermal fuse physically located with the board in a manner which will protect against thermal runaway which could occur due to a failure of electronic components in the design. Surge protector VR1 protects against transient voltage spikes.

The circuit comprised of R1, C1, D1, D2 and C2, provide a reduction of AC mains to a voltage level that can be managed by +5 volt regulator U1. U1 provides a regulated +5 volt power source which is used to power the CPU (U2) and associated components.

CPU Functions

The CPU (U2) is a PIC microcontroller, type PIC16C710. Firmware in the PIC's EPROM define the inputs and outputs as well as the mode functions and associated driving of the LED display, temperature control of the board and determination of the availability of power for the board and iron heating elements.

Initially upon connection of the circuit to AC Mains, the CPU boots up and waits until the iron, set in an on condition, is detected. At this point power is not supplied to either the Iron or Board heating elements. Additionally, all LEDs are off.

The intended use of the product requires that an iron be plugged into the outlet provided on the board. Assuming this is done, and the iron is set to a desired ironing temperature, an AC voltage will be presented to the circuit comprised of R11, R12 and the LED side of opto-isolator U3. The presence of the AV voltage drives U3 on, causing a low logic level during a portion of the AC cycle at U2 port RB5. The firmware running in the CPU detects the low level on RB5 and then enables the operation of the mode switch. When the mode switch is advanced (by pressing it one or more times) Q2, a triac, is driven to an on state. This supplies AC mains to the iron. The mode switch hereafter remains enabled during the normal use of the iron.

However, after an amount of time passes that suggests that the iron has been turned off or unplugged, all power to both the board and iron ceases and the circuit reverts to an off position.

As the iron heats, the user may select the desired board temperature by successive presses of the mode switch. The selected setting is indicated by three LEDs, D3, D4 and D5.

Analog to Digital Conversion/Board Temperature Control

A reference voltage is set by resistor which is mounted in close proximity to the board heating element. The circuit which includes TS1 and RS forms a voltage divider and is connected to CPU port pin RA0. This voltage is proportional to the temperature of the board.

The A/D converted function of the CPU compares the analog signal voltage present on value is calculated and stored in a CPU register, referred to as "Vtemp". Vtemp is a number from 00h to ffh that represents the amplitude of the voltage from the temperature sensor that is measuring the temperature of the board. The CPU firmware them compares the valve of "Vtemp" to high and low limit values set in a pair of registers associated with each of the three active mode settings. If the value of Vtemp is larger than then high limit, board heating is disabled. If the value of Vtemp is lower than the low limit value selected from that mode then board heating is enabled. Heating of the board remains enabled until the Vtemp value is greater than the high limit register for the mode setting, or the iron requests power, or if the mode control is changed to a lower temperature setting or set to off.

Sensing of the Iron and Power Management

Sensing of the status of the iron is done using the circuit which includes opto-isolator U3 and associated components R11, R12.

When power is called for by the iron, the thermostat internal to the iron connects the heating element of the iron to the AC plug which is plugged into the iron output of the circuit. This presents an AC voltage which after voltage division turns on the LED internal to U3 and provides a low logic level to CPU input RB5. This causes the CPU to respond immediately by turning on Q2, which turns on the iron, while setting Q1 off (if it was previously on) and thus removing any power to the board heating element.

Once Q2 is activated, U3 is no longer able to detect the state of the iron. This is due to the fact that no potential difference remains across the LED of U3 when Q2 is on. The output of U3, connected to CPU port RB5, thus goes back to a high position. This would logically be interpreted by the CPU that the iron is in an off state or has been unplugged, and this would result in power being restored to the board heating elements. Obviously, the iron would never be able to reach a proper temperature due to the fact that power to the iron would rapidly cycle on and off in an undesirable manner.

The firmware solves this problem by cycling Q2 to an off state for the minimum time for the CPU to read the logic state of port RB5 while Q2 is off. This is done repeatedly over a period of seconds. It can then be determined by the CPU when the iron is no longer requiring power when the conditions of reaching the setting on the iron's thermostat, or having been turned off, or unplugged from the board are established. The CPU then makes the decision whether or not to turn on Q1, thus enabling power to the board heating element, if heat is called for by the board thermostat.

At any time that the iron calls for power, this is instantly detected by the CPU causing the board power to be disabled and the iron power enabled.

Other Component Functions

R2 is used to provide current limiting for the three LEDs, D3, D4 and D5. C3 is a decoupling capacitor connected across the +5V buss and common. R3 provides pull up for CP port RB0, which is connected to the Mode switch. R7, R8 and R9 are port pull up resistors. R21 and C4 determine the clock frequency of the CPU. R13, C6 and R14, C5 are included for dc isolation from the triac gates. The triacs are driven by a pulse stream which originates from the CPU.

Figure 2:
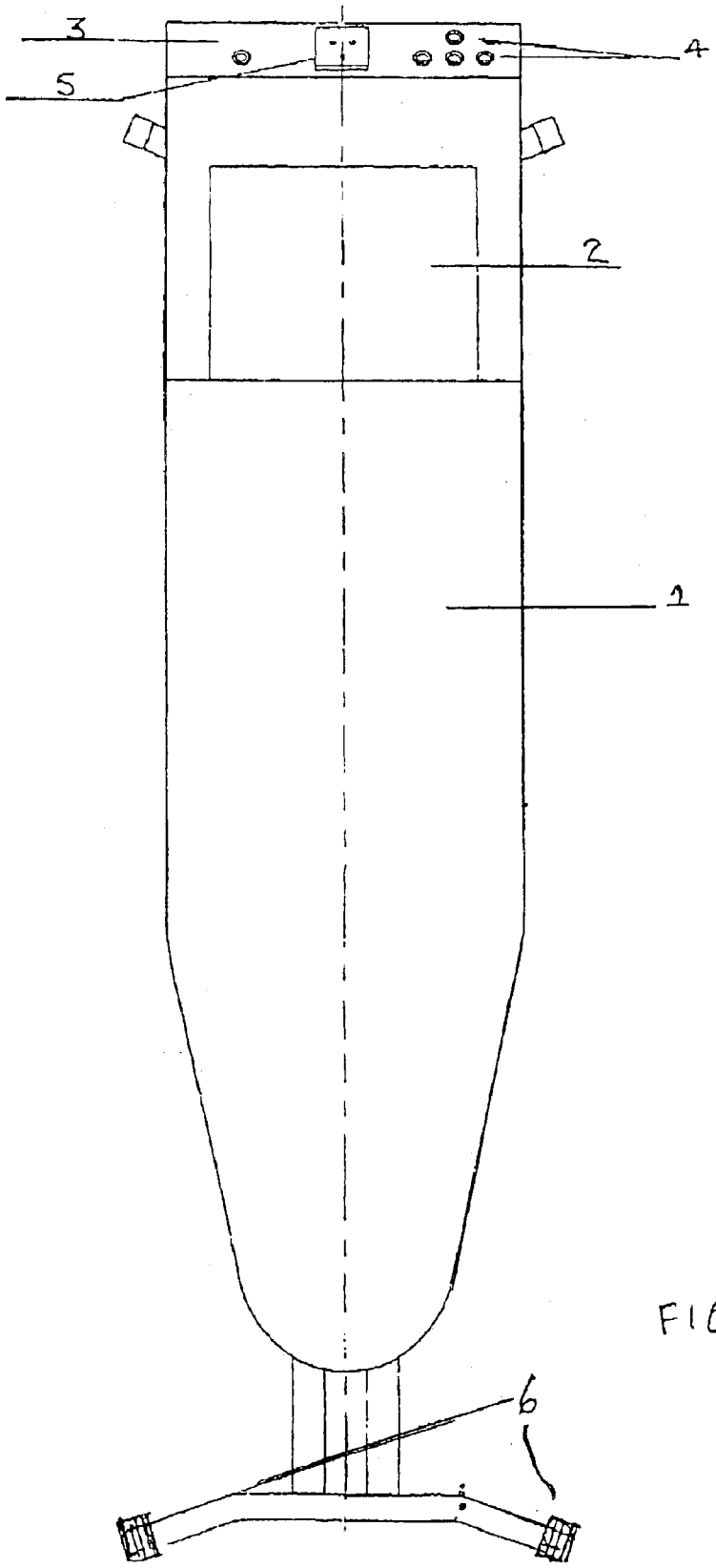
FIG. 2 is a front view in the storage position of an ironing board incorporating a power management system and (not shown in this view) a motor and drive mechanism to raise and lower the board.
Figure 3:
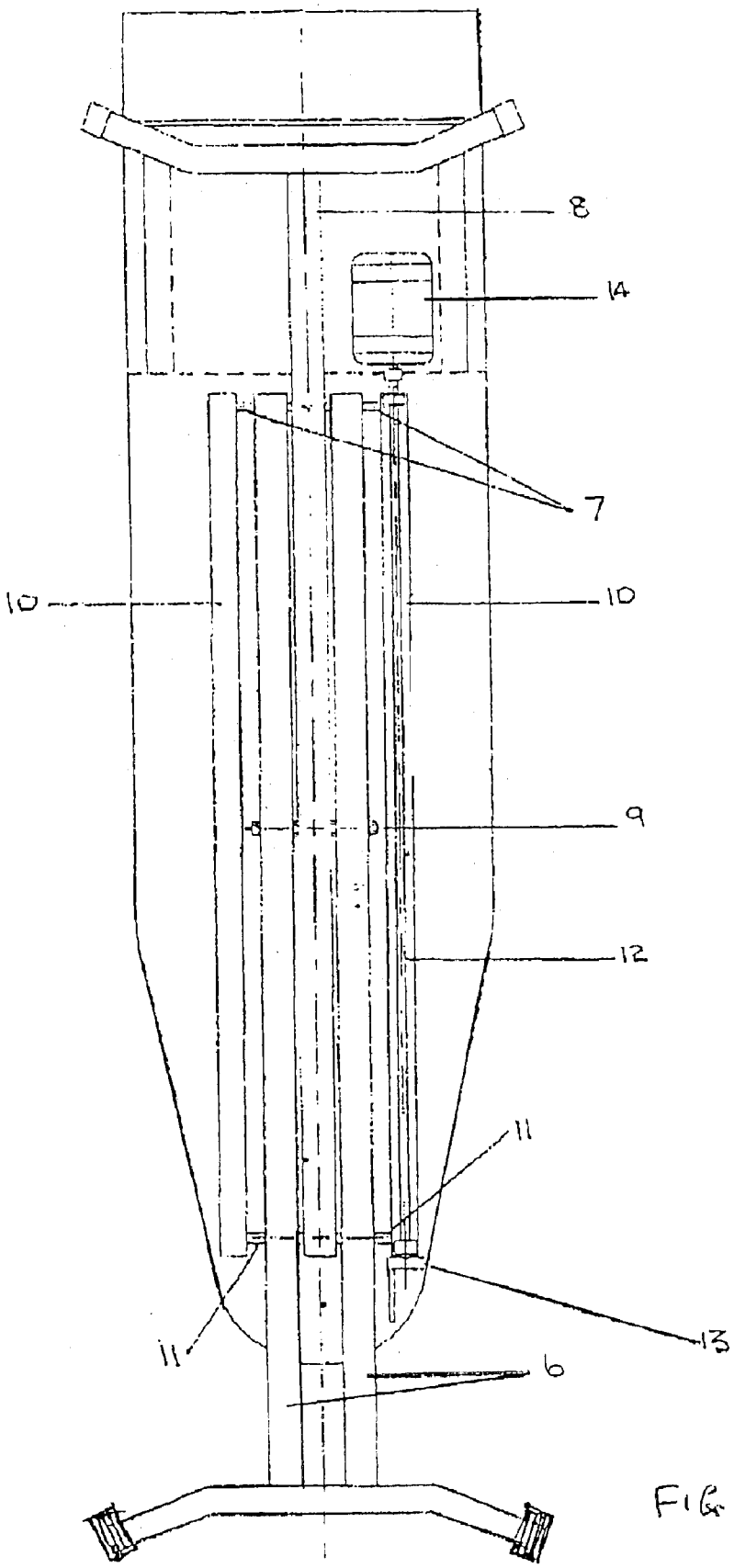
FIG. 3 is a rear view of the board of FIG. 2.
Figure 4:
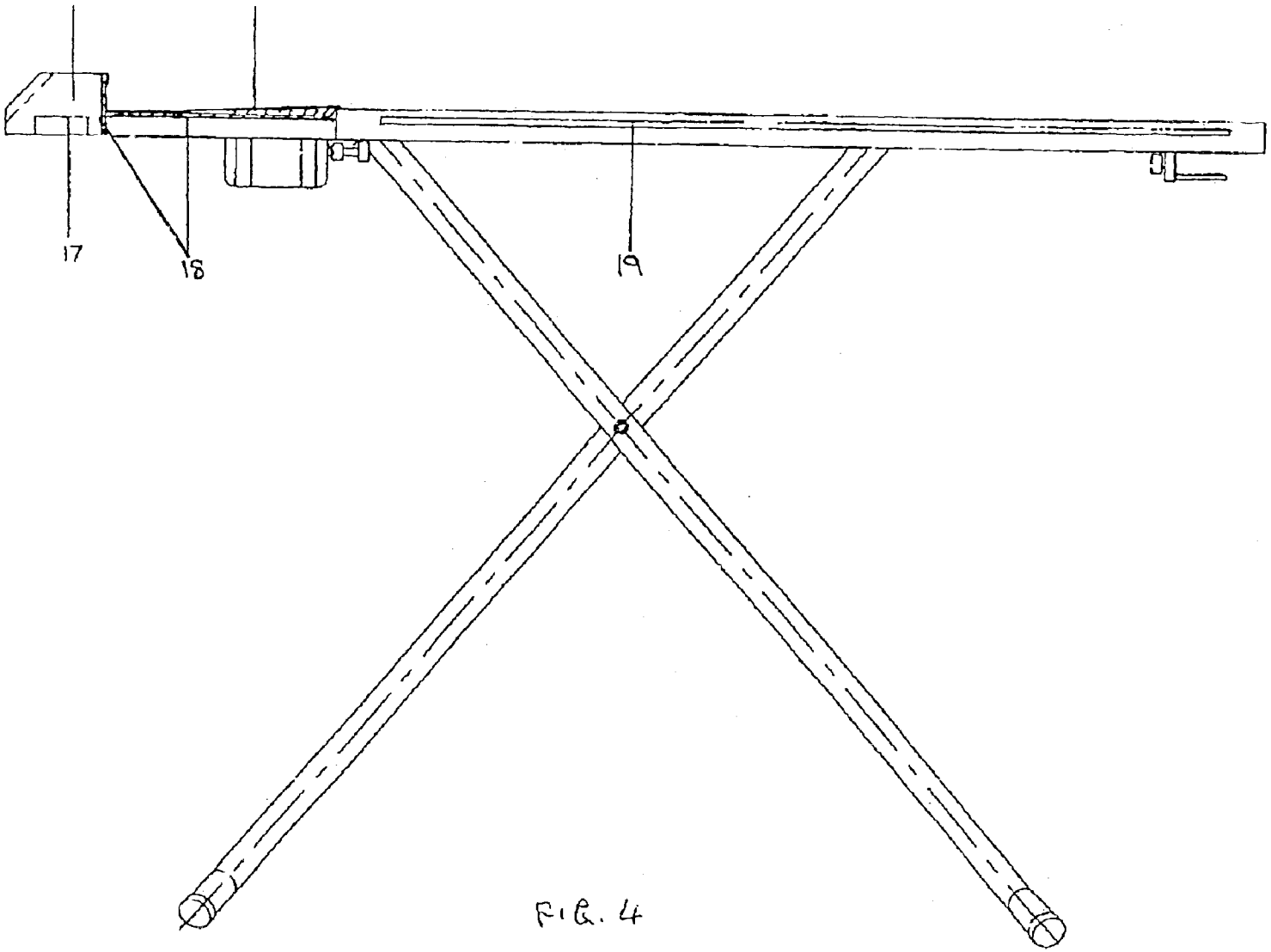
FIG. 4 is a side view of the board of FIG. 2, in the working position.

Referring now to FIGS. 2 to 4, an ironing board with an electrically heated working surface with temperature control, provision for the connection of an electrically heated iron and housing for the present invention electronic power management system situated at the rear is illustrated. The appliance may be optionally powered by the inclusion of a suitably geared motor and worm drive shaft as illustrated.

In FIG. 2, a front view of the upper working surface (1) of the ironing board is shown with the iron rest (2) as an integral part of the upper working surface and control housing. A control panel (3) is located at the rear of the board, the facial panel of the control box containing the mode switch and indicator lights (4) which indicate the selected temperature of the working surface of the board.

Located in the centre of the facia panel is a power socket (5) which is the power source for an electric iron. This location facilitates the use of an iron from either side of the board making it a left or right handed appliance (6) indicating legs and roller feet to ease transfer from place of storage to place of operation.

FIG. 3 Illustrates an underside view of the board showing the position of the rear support leg (6) which is attached to the underside of the board by two hinges (7) that lock the support leg into a static position. The forward support leg (8) is pivotally attached to leg (6) at (9), allowing the forward leg to move forward and backwards to adjust the horizontal height of the board working surface.

To assist movement of the forward leg, support channel assemblies (10) are located on the underside of the board. Guide rollers (11) are mounted on the upper part of the front support let for movement in the channels, ensuring smooth running when adjustment takes place.

Adjustment is made by means of a worm drive (12) attached to the underside of the board. Manual horizontal movement is achieved by means of a folding handle (13) situated at one end of the drive shaft. An alternative means of achieving horizontal movement of the work surface is the inclusion of a small electric motor (14) sited at the opposite end of the drive shaft to the folding handle. Direct control for the motor would be located on the facial panel of the control box, and/or by a remote infra red unit. The work and reduction gear will interlock with the handle and motor by way of a small drive coupling.

FIG. 4 illustrates the ironing board in the conventional work position. The electronic load management circuitry is housed within the control box (15).

The circuit board is protected from heat emanating from the iron by a heat insulating shield (18) below and to the side of the iron rest.

The view demonstrates the angle of the recess containing the iron rest platform for ease of use and maximum stability of the iron while in the park position. The board is heated by an electrical element (19) controlled by the circuitry in the control box.

We claim:

1. An ironing board comprising an electrical heater, an electrical outlet for powering an iron, a connector for connecting the board to a power source and a controller for controlling the supply of power to the heater and the outlet, wherein the controller is arranged to prevent power being supplied to both the outlet and the heater simultaneously and to give priority to the iron if both the heater and an iron connected to the outlet request power simultaneously and wherein the controller comprises a sensor which detects whether an iron connected to the outlet is requesting power.

2. An ironing board according to claim 1 wherein the sensor comprises an opto-isolator.

3. An ironing board according to claim 1 wherein the controller is arranged such that connection of an iron to the outlet enables the completion of a circuit to a sensor in the controller.

4. An ironing board according to claim 3 wherein the controller is such that a demand for power arising within an iron connected to the outlet completes said circuit causing the sensor to signal the iron's demand to the controller.

5. An ironing board according to claim 1 wherein the controller periodically ceases the supply of useful power to an iron connected to the outlet to determine during such cessations whether the iron is still requesting power.

6. An ironing board according to claim 1 wherein the controller comprises a microcontroller for dictating the supply of mains power to the outlet and the heater.

7. An ironing board according to claim 1 wherein the controller is programmed to provide either a fixed differential between the board and iron operating temperatures for any given setting or a proportional differential.

8. An ironing board according to claim 1 wherein the controller includes switch means associated with the iron electrical outlet to isolate the electrical heater from receiving power unless an iron is connected to the iron electrical outlet.

* * * * *